US012628997B2

(12) United States Patent
Weyhmiller

(10) Patent No.: US 12,628,997 B2
(45) Date of Patent: May 19, 2026

(54) CLEANING PAD

(71) Applicant: Bonakemi USA, Incorporated, Englewood,, CA (US)

(72) Inventor: Todd Weyhmiller, Englewood, CO (US)

(73) Assignee: BONAKEMI USA, INCORPORATED, Aurora, CO (US)

( * ) Notice: Subject to any disclaimer, the term of this patent is extended or adjusted under 35 U.S.C. 154(b) by 0 days.

(21) Appl. No.: 18/524,308

(22) Filed: Nov. 30, 2023

(65) Prior Publication Data

US 2024/0090737 A1 Mar. 21, 2024

Related U.S. Application Data

(63) Continuation of application No. 17/101,971, filed on Nov. 23, 2020, now Pat. No. 11,864,703, which is a continuation of application No. 16/257,427, filed on Jan. 25, 2019, now Pat. No. 10,881,263, which is a continuation of application No. 15/208,524, filed on Jul. 12, 2016, now Pat. No. 10,231,593.

(60) Provisional application No. 62/191,929, filed on Jul. 13, 2015.

(51) Int. Cl.

| | |
|---|---|
| ***A47L 13/16*** | (2006.01) |
| ***A47L 11/14*** | (2006.01) |
| ***A47L 11/40*** | (2006.01) |
| ***A47L 13/20*** | (2006.01) |
| ***A47L 13/256*** | (2006.01) |

(52) U.S. Cl.
CPC ..... *A47L 13/16* (2013.01); *A47L 11/14* (2013.01); *A47L 11/4038* (2013.01); *A47L 13/20* (2013.01); *A47L 13/256* (2013.01)

(58) Field of Classification Search
CPC ..... A47L 13/20; A47L 13/16; A47L 13/256; A47L 11/14; A47L 11/4038
See application file for complete search history.

(56) References Cited

U.S. PATENT DOCUMENTS 8,863,347 B2 * 10/2014 Wildeman ..... A47L 13/44 15/228
2008/0280094 A1 * 11/2008 Wildeman ..... A47L 13/16 15/208

* cited by examiner

*Primary Examiner* — Shay Karls
(74) *Attorney, Agent, or Firm* — Amy E. Allen Hnson; Parker Poe Adams & Bernstein, LLP

(57) ABSTRACT

A cleaning pad is disclosed. The cleaning pad may include a body having a top layer for securing to a mop head and a bottom layer for making contact with a floor surface. The bottom layer may be generally rectangular in shape and include a first and second strip of relatively lower absorbency material and a strip of relatively higher absorbency material. The first strip of relatively lower absorbency material may extends along a first longitudinal edge from the first to the second lateral edges of the bottom layer. The second strip of relatively lower absorbency material may extend along a second longitudinal edge also from the first to the second lateral edges of the bottom layer. The strip of relatively higher absorbency material may extend from the first to the second lateral edges and between the first strip and the second strip of relatively lower absorbency material.

22 Claims, 4 Drawing Sheets

CLEANING PAD

REFERENCE TO RELATED APPLICATIONS

This application which is a continuation of application Ser. No. 16/257,427, claims the benefit of the following U.S. patent applications: U.S. Provisional Application Ser. No. 62/191,929 filed Jul. 13, 2015; U.S. Nonprovisional application Ser. No. 15/208,524, filed Jul. 12, 2016, now U.S. Pat. No. 10,231,593, claiming priority from said U.S. Provisional Application Ser. No. 62/191,929; U.S. application Ser. No. 16/257,427 filed Jan. 25, 2019, now U.S. Pat. No. 10,881,263, which is a continuation of application Ser. No. 15/208,524; and U.S. application Ser. No. 17/101,971 filed Nov. 23, 2020, which is a continuation-in-part of application Ser. No. 16/257,427, all of which are hereby incorporated by reference for all that is disclosed therein.

BACKGROUND

Modern cleaning pads for wood floor mops are typically rectangular in shape and are removably attached, as by a hook and loop fasteners, to a mop head of similar shape. A cleaning pad often includes a fabric that is attached to the mop head and a floor engaging fabric that is attached to the first fabric. One popular cleaning pad material for floor mops is microfiber because of its ability to trap and retain dirt and absorb liquids. However, a problem with current microfiber cleaning pads is that such pads tend to glide over the floor and are thus not effective for scrubbing applications. Floor contractors often use cut pile microfiber for tacking floors. Such pads are highly moisture absorbent. However, such cut pile microfiber pads when used on a floor mop are extremely difficult to push across a floor when the pad is wet.

SUMMARY

This specification discloses a cleaning pad having at least one strip of relatively lower absorbency material such as cut pile microfiber and at least one strip of relatively higher absorbency material such as loop microfiber. Embodiments of such a cleaning pad have a combination of features including good wetting of food/dirt/small particles and low friction displacement of the mop head, provided primarily by the relatively lower absorbency material; and good moisture absorption and good food/dirt/small particle capture, provided primarily by the relatively higher absorbency material.

In one embodiment of the present invention, a cleaning pad is disclosed. The cleaning may include a generally rectangular body having a top material layer for securing to a cleaning pad displacement apparatus, such as a mop, and a bottom material layer for making contact with a floor surface. The top material layer and bottom material layer may be secured to each other. Further, the bottom material layer may be generally rectangular in shape and includes first and second longitudinal edges and first and second lateral edges. The bottom material layer may further include a first and a second strip of relatively lower absorbency material and a strip of relatively higher absorbency material. The first strip of relatively lower absorbency material may extend along the first longitudinal edge from the first lateral edge to the second lateral edge. Furthermore, the second strip of relatively lower absorbency material may extend along the second longitudinal edge from the first lateral edge to the second lateral edge. The first strip of relatively higher absorbency material may extend from the first lateral edge to the second lateral edge and between the first strip and the second strip of relatively lower absorbency material.

In another embodiment of the present invention, a cleaning pad is disclosed. The first and second strips of relatively lower absorbency material may include loop microfiber and the strip of relatively higher absorbency material may include cut microfiber.

The present invention also includes a method for manufacturing a cleaning pad. The method may include the step of providing a generally rectangular body as set forth above. The method may further include the step of providing a cleaning pad displacement apparatus, wherein the cleaning pad is for attaching to the cleaning pad displacement apparatus to displace the cleaning pad across a floor surface in cleaning engagement therewith.

DETAILED DESCRIPTION

Figure 1:
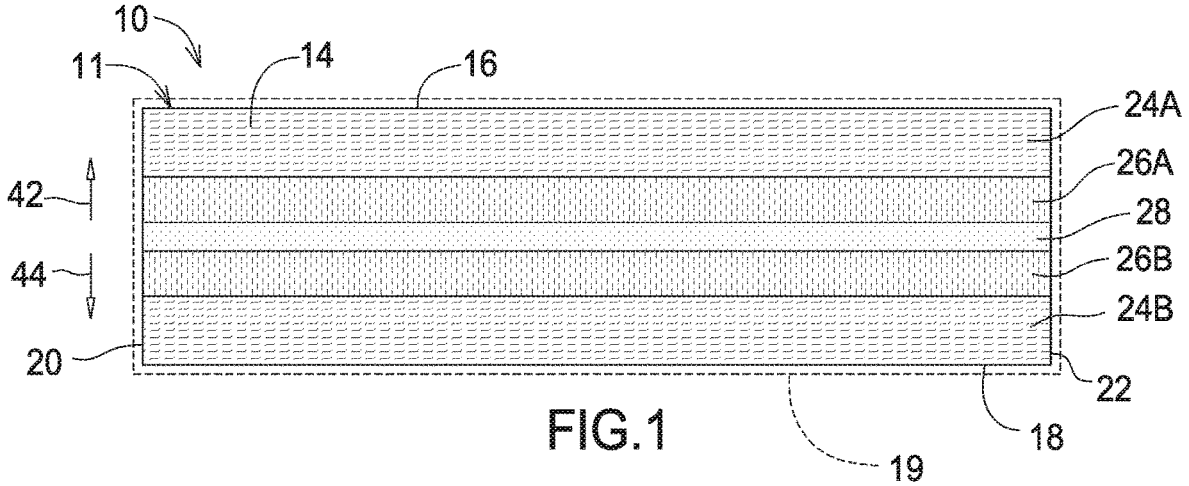
FIG. 1 is a bottom plan view an example embodiment of a cleaning pad.
Figure 2:
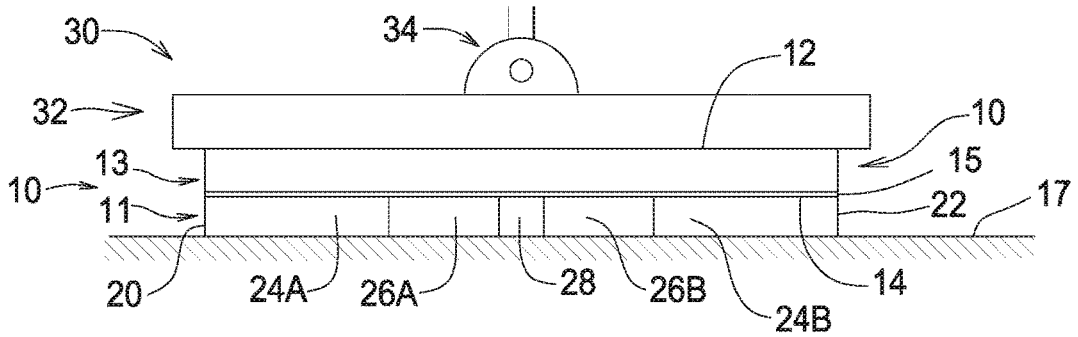
FIG. 2 is a cross-sectional side elevation view of the cleaning pad of FIG. 1 mounted on a mop.

FIG. 1 is a bottom plan view an example embodiment of a cleaning pad 10. FIG. 2 is a side elevation view of the cleaning pad 10 mounted on a mop head 32 of a floor mop 30. The mop head 32 may be conventionally attached to a mop handle assembly 34. The cleaning pad 10, as best shown in FIG. 2, has a bottom material layer 11, which makes contact with a floor surface 17 to be scrubbed, and a top material layer 13. The bottom and top layers 11, 13 are connected as by adhesive 15 or by stitching or by other attachment means.

The materials used in the bottom layer include a relatively lower absorbency material and a relatively higher absorbency material. One measure of absorbency is based on the weight of water absorbed by the material after it has been placed in a water bath for a predetermined period of time, for example 10 minutes. The amount of material tested may be specified by the surface area of the tested samples, when all samples tested have approximately the same thickness. Thus, in one testing method, the absorbency of the material is expressed in grams of water absorbed per square centimeter of material.

In one example embodiment, for the relatively lower absorbency material, the water absorption per unit area was about 0.226 $g/cm_2$. Performing the same test on the strip of relatively higher material, the water absorption per unit area was about 0.308 $g/cm_2$. Thus, the relatively higher material had an absorption rate about 1.36 times higher than that of the relatively lower absorbency material. In another embodiment, the relatively higher material had an absorption rate about 1.60 times higher than that of the relatively lower absorbency material.

The top layer 13 of the pad 10 may be a unitary sheet of fabric that may be made from cotton, wool, or a manmade fiber such as nylon, or other backing material. In one embodiment the top layer 13 (sometimes referred to herein as "backing material") has a composition of 100% polyester. As best shown in FIG. 1, the pad bottom layer 11, which may be generally rectangular in shape, has first and second longitudinal edges 16, 18 and first and second lateral edges 20, 22. In some embodiments a strip of fabric material 19, shown in dashed lines, is folded over the bottom and top layers 11 and 13. The strip 19 is attached to the pad at its outer edges 16, 18, 20, 22 by stitching or other attachment means. The bottom layer 13 is composed of multiple laterally extending, parallel strips of material that may be sewn or otherwise connected at the abutting edges thereof. In the example embodiment shown in FIG. 1 the bottom layer 11 is formed by two outer strips of relatively lower absorbency material 24A and 24B, two inner strips of relatively higher absorbency material 26A and 26B and a central strip of scrubbing/bristle material 28.

In one embodiment the scrubbing/bristle material is white nylon bristles, in another it is polyester scrubbers—a stiff, brush like material. However, the bristles could be made from any sufficiently stiff and wear resistant manmade material, plant fiber or animal hair. The bristles, as well as improving the scrubbing efficiency of the mop, are very useful when encountering bevel or grout lines where current mops do not perform well. The scrubbing/bristle material has a very low water absorption per unit area. In most example embodiments, the water absorption per unit area is negligible.

The relatively lower absorbency material 24A, 24B could be any of the following materials, or other materials: 100% polyester twist loop microfiber material or 2 Denier 100% polyester 1 ply material.

The relatively higher absorbency material 26A, 26B could be any of the following materials, or other materials: cut pile microfiber, or an 80/20 Polyester/Nylon blend, untwisted composition material or an 80% Polyester, 20% Polyamide, 3 plies material.

In the embodiment of FIG. 1, the relatively lower absorbency material 24A, 24B occupies about 50% of the total surface area, the relatively higher absorbency material 26A, 26B occupies about 40% and the scrubbing/bristle material occupies about 10%. In a slightly different version, the strip layout order is the same, except that the relatively lower absorbency material strips 24A, 24B occupy about 40% of the total surface area, the relatively higher absorbency material strips 26A, 26B occupy about 50% of the total surface area and the scrubbing/bristle material strip 28 occupies about 10% of the total surface area. Other strip area ratios may also be used. As best shown by FIG. 2, in one embodiment, the strips of relatively higher absorbency material 26A, 26B and the strips or relatively lower absorbency material 24A, 24B are substantially equal height such that the bottom surfaces of the strips are substantially coplanar and all simultaneously engage the floor surface 17.

Figure 3:
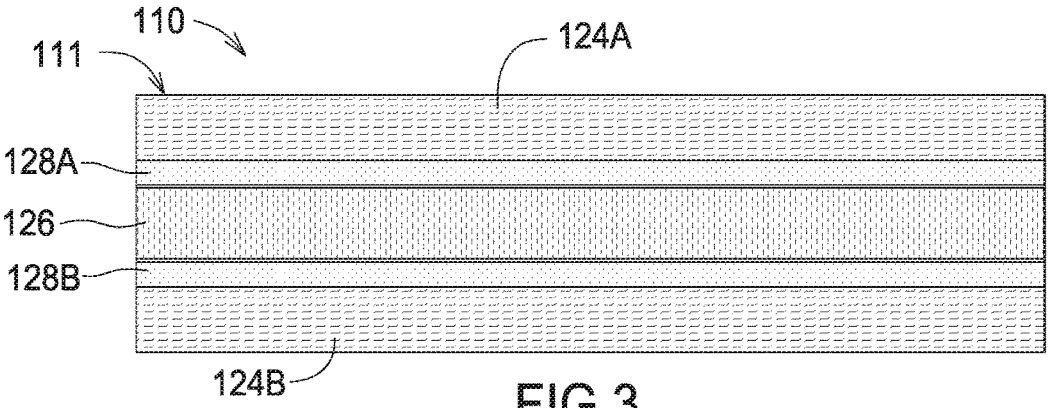
FIG. 3 is a bottom plan view of another example embodiment of a cleaning pad.

FIG. 3 is a bottom plan view of a cleaning pad 110 of the same type as the cleaning pad 10 shown in FIG. 1, but with a different arrangement of material strips in the bottom layer 111 thereof. In this embodiment a relatively higher absorbency material strip 126 is located at the center of the bottom layer 111. A scrubbing/bristle material strip 128A or 128B is attached to either side of the cut pile strip 126. A relatively lower absorbency material strip 124A and 124B is attached to each of the scrubbing/bristle material strips 128A, 128B, respectively. The area ratios of each strip type may be the same as in the two versions of the cleaning pad 11 described above with reference to FIG. 1, i.e., in a first version the relatively lower absorbency material strips occupy about 50% of the total surface area, the relatively higher absorbency material strips occupy about 40% and the scrubbing/bristle material strip occupies about 10%. In a second version, the relatively lower absorbency material strips occupy about 40% of the total surface area, the relatively higher absorbency material strips occupy about 50% of the total surface area and the scrubbing/bristle material strip occupies about 10% of the total surface area. In the embodiment of FIG. 3, the scrubbing/bristle material strips 128A, 1288 may each be about 60 mm wide in both of the different area ratio versions.

One advantage of some embodiments of the cleaning pads illustrated in FIGS. 1-3 is that most consumers using such a cleaning pad on a mop, would be able to push the mop across a wood floor without difficulty.

Figure 4:
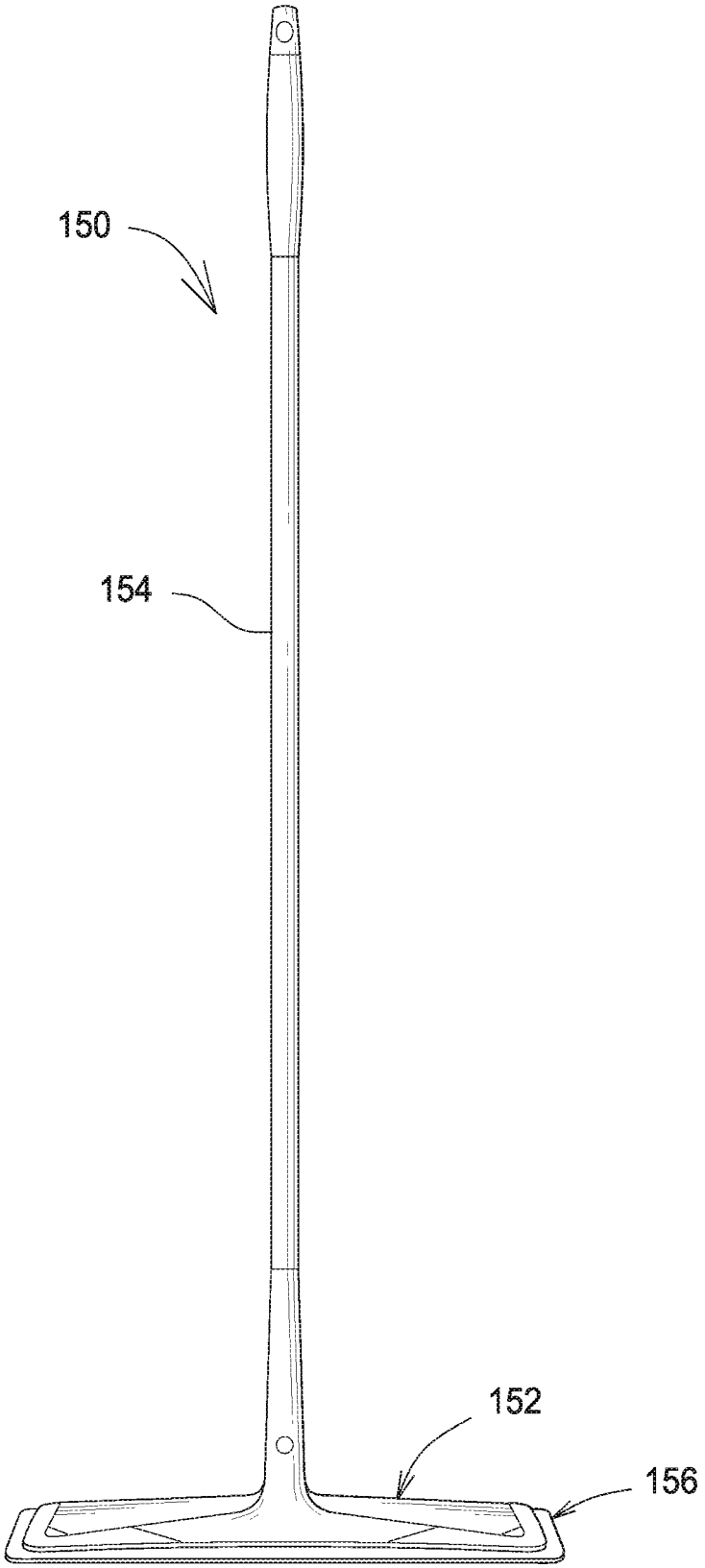
FIG. 4 is an isometric view of a floor mop that includes the cleaning pad of FIG. 1.

FIG. 4 illustrates a floor mop 150 having a mop head 152 with an elongate handle 154 attached thereto. A cleaning pad 156, which may be similar or identical to the cleaning pads 10 or 110 described herein, is attached to the bottom of the mop head 152 as by hook and loop fasteners or other attachment means. Thus, the floor mop 150 may comprise a mop head 152 having attached thereto a cleaning pad 156. The cleaning pad has at least one strip of relatively lower absorbency material, e.g., strip 24A (FIG. 1), at least one strip of relatively higher absorbency material, e.g., strip 26A (FIG. 1) and at least one strip of scrubbing/bristle material, e.g., strip 28 (FIG. 1).

Figure 5:
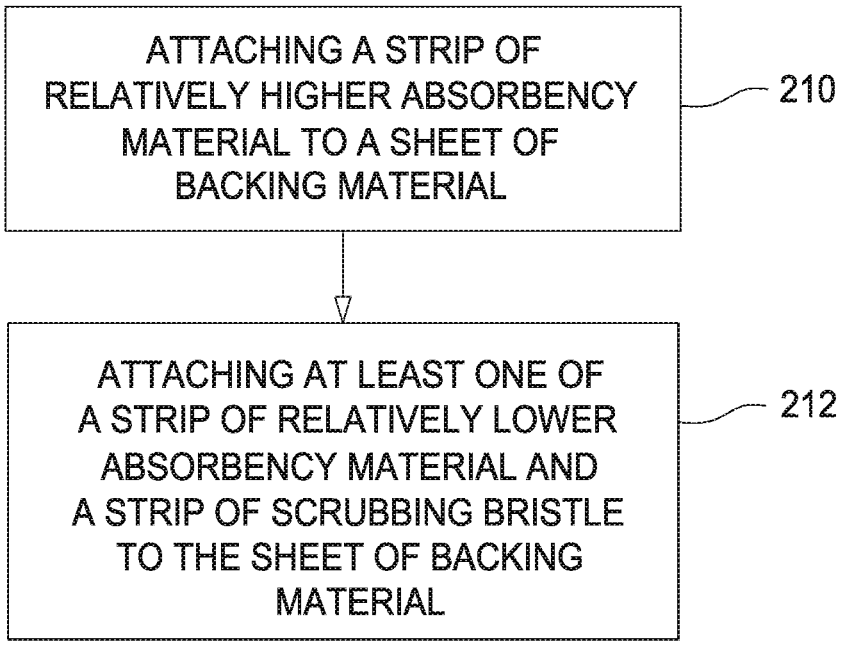
FIG. 5 is a flow diagram of a method of making a cleaning pad.

FIG. 5 is a flow diagram of an example method of making a cleaning pad. The method, in one embodiment, includes, as shown at block 210, attaching a strip of relatively higher absorbency material to a sheet of backing material. The method may also include, as shown at block 212, attaching at least one of a strip of relatively lower absorbency material and a strip of scrubbing/bristle material to the sheet of backing material.

The strips may be linear strips positioned in a parallel relationship as shown in FIGS. 1 and 3. However, the strips may be otherwise arranged, for example, the strips may be divided into small squares and arranged in a checkerboard pattern (not shown). Also, rather than being linear, the strips could have a snake-like, undulating configurations (not shown), or other configurations.

Figure 7:
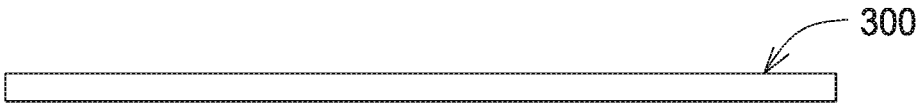
FIG. 7 is a side elevation view of another example embodiment of a cleaning pad.

In some embodiments the backing material, e.g. top material layer 13 is eliminated and the various strips of relatively lower absorbency material, relatively higher absorbency material and scrubbing/bristle material are attached at adjacent edges thereof directly to one another, for example, such as shown in FIG. 1 or 3. A side elevation view of such a cleaning pad 300 is illustrated in FIG. 7.

Figure 6:
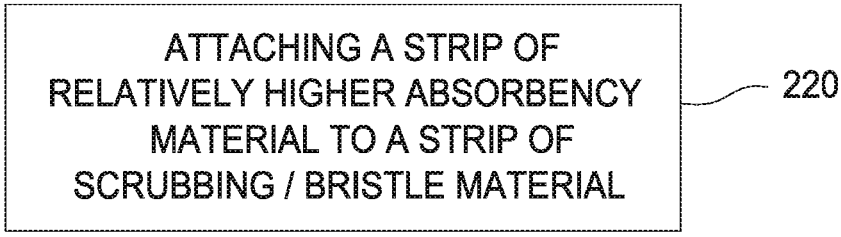
FIG. 6 is a flow diagram of another method of making a cleaning pad.

FIG. 6 is a block diagram of another embodiment of a method of making a cleaning pad. The method includes, as shown in block 220, attaching a strip of relatively higher absorbency material to a strip of scrubbing/bristle material. Other methods include the method of FIG. 6 and further steps, for example: attaching a second strip of relatively higher absorbency material to the strip of scrubbing/bristle material and attaching a first and second strip of relatively lower absorbency material to the first and second strips of relatively higher absorbency material, respectively. Still other embodiments include the method of FIG. 6 and further comprise attaching a strip of relatively higher absorbency material to the strip of scrubbing/bristle material; and may further include attaching a second strip of scrubbing/bristle material to the strip of relatively higher absorbency material and may further include attaching a second strip of relatively lower absorbency material to the second strip of scrubbing/bristle material.

Figure 8:
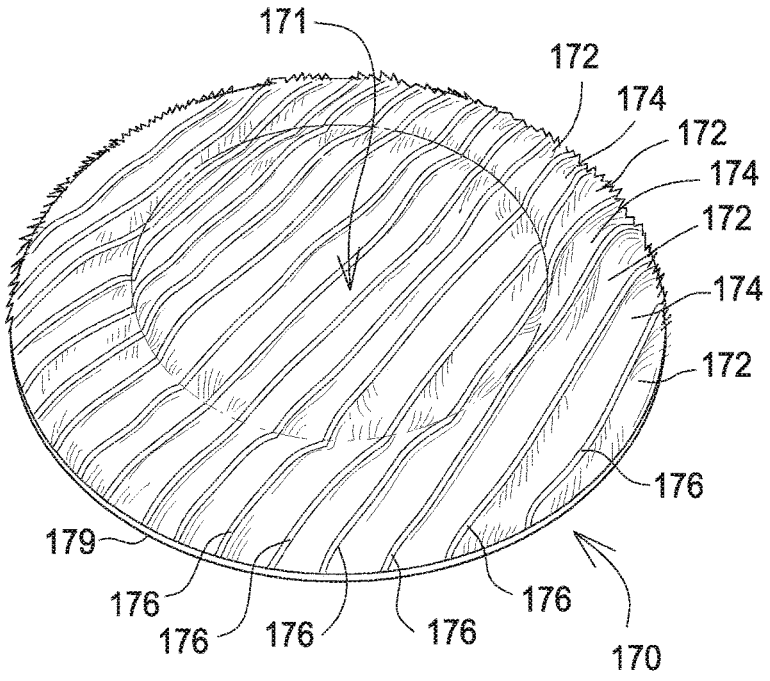
FIG. 8 is a bottom plan view of an example embodiment of a cleaning bonnet for a rotary floor care machine.

FIG. 8 is a bottom plan view of an example embodiment of a cleaning bonnet 170 for a rotary floor care machine. The cleaning bonnet comprises a floor engaging face 171 having alternating higher absorbency strips 172 and lower absorbency strips 174 with harder surfaces scrubbing material strips 176 positioned between each pair of higher absorbency strips 172 and lower absorbency strips 174. The higher absorbency strips 172 and lower absorbency strips 174 may be constructed from the same material as described above for the cleaning pad 10 or may be made from other materials. The scrubbing material strips 176 may be made of nylon or other scrubbing material.

Figure 9:
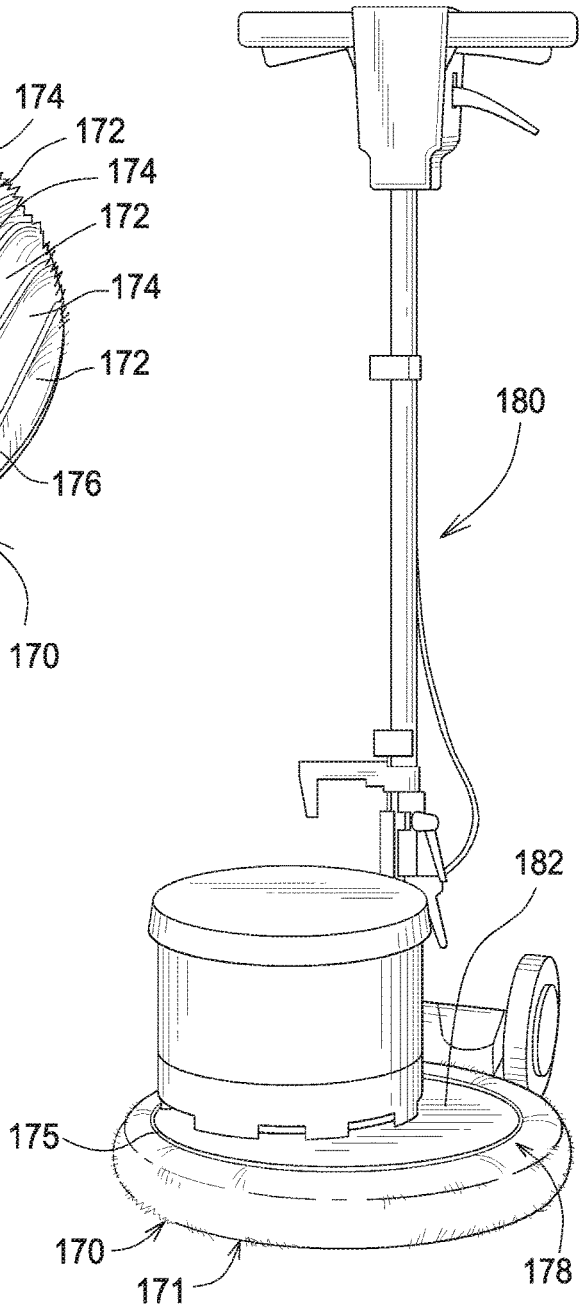
FIG. 9 is a side elevation view of a rotary floor care machine having a cleaning bonnet mounted thereon.

FIG. 9 is a side elevation view of a rotary floor care machine 180, such as a buffer having a cleaning bonnet mounted thereon. A sander (not shown) may be substituted for the buffer in some embodiments. The rotary floor care machine 180 has a rotary head 182. The cleaning bonnet 170 has a skirt portion 178 attached to the face 171 as by a seam or material strip 179. The skirt portion 178 encompasses a peripheral portion of the rotatory head. A draw string 175 or elastic band or other securing means provided at the edge of the skirt securely fastens it to the rotating head 182.

Various embodiments of cleaning pads, mop assemblies with cleaning pads and methods of making cleaning pads have been disclosed in detail herein. Alternative embodiments of such cleaning pads, mop assemblies and associated methods will occur to those skilled in the art after reading this disclosure. It is intended that the appended claims be construed broadly to cover such alternative embodiments, except as limited by the prior art.

What is claimed is:

1. A cleaning pad comprising:

a generally rectangular body comprising:

a top material layer for securing to a cleaning pad displacement apparatus; and a bottom material layer for making contact with a floor surface;

wherein the top material layer and bottom material layer are secured to each other;

wherein the bottom material layer is generally rectangular in shape and includes first and second longitudinal edges and first and second lateral edges; wherein the bottom material layer further includes a first and a second strip of relatively lower absorbency material and a strip of relatively higher absorbency material;

wherein the first strip of relatively lower absorbency material extends along the first longitudinal edge from the first lateral edge to the second lateral edge;

wherein the second strip of relatively lower absorbency material extends along the second longitudinal edge from the first lateral edge to the second lateral edge;

wherein the strip of relatively higher absorbency material extends from the first lateral edge to the second lateral edge and between the first strip and the second strip of relatively lower absorbency material; and wherein the first and second strips of said relatively lower absorbency material and the strip of relatively higher absorbency material are substantially equal height and form a substantially coplanar floor engaging surface.

2. The cleaning pad of claim 1, wherein the strip of relatively higher absorbency material comprises cut microfiber.

3. The cleaning pad of claim 1, wherein the strip of relatively higher absorbency material comprises a polyester and nylon blend or a polyester and polyamide blend.

4. The cleaning pad of claim 1, wherein the strip of relatively higher absorbency material comprises three plies material.

5. The cleaning pad of claim 1, wherein the strip of relatively higher absorbency material comprises loop microfiber.

6. The cleaning pad of claim 1, wherein the first and second strips of relatively lower absorbency material comprises loop microfiber.

7. The cleaning pad of claim 6, wherein the first and second strips of relatively lower absorbency material comprises twist loop microfiber.

8. The cleaning pad of claim 1, wherein the first and second strips of relatively lower absorbency material comprises polyester.

9. The cleaning pad of claim 1, wherein the first and second strips of relatively lower absorbency material comprises 1 ply material.

10. The cleaning pad of claim 9, wherein the first and second strips of relatively lower absorbency material comprises polyester.

11. The cleaning pad of claim 1, wherein the first and second strips of relatively lower absorbency material comprise 40-50% of the floor engaging surface.

12. The cleaning pad of claim 1, wherein the strip of relatively higher absorbency material comprises 40-50% of the floor engaging surface.

13. The cleaning pad of claim 1 further comprising the cleaning pad displacement apparatus, wherein the cleaning pad is for attaching to the cleaning pad displacement apparatus to displace the cleaning pad across a floor surface in cleaning engagement therewith.

14. The cleaning pad of claim 1, wherein the top material layer comprises backing fabric.

15. The cleaning pad of claim 1, wherein the relatively higher absorbency material has an absorbency of at least about 1.36 times that of the relatively lower absorbency materials.

16. A cleaning pad comprising:

a generally rectangular body comprising:

a top material layer for securing to a cleaning pad displacement apparatus; and a bottom material layer for making contact with a floor surface;

wherein the top material layer and bottom material layer are secured to each other;

wherein the bottom material layer is generally rectangular in shape and includes first and second longitudinal edges and first and second lateral edges; wherein the bottom material layer further includes a first and a second strip of relatively lower absorbency material and a strip of relatively higher absorbency material;

wherein the first strip of relatively lower absorbency material extends along the first longitudinal edge from the first lateral edge to the second lateral edge;

wherein the second strip of relatively lower absorbency material extends along the second longitudinal edge from the first lateral edge to the second lateral edge;

wherein the strip of relatively higher absorbency material extends from the first lateral edge to the second lateral edge and between the first strip and the second strip of relatively lower absorbency material;

wherein the first and second strips of relatively lower absorbency material comprise loop microfiber and the strip of relatively higher absorbency material comprises cut microfiber; and wherein the first and second strips of said relatively lower absorbency material and the strip of relatively higher absorbency material are substantially equal height and form a substantially coplanar floor engaging surface.

17. The cleaning pad of claim 16 further comprising a cleaning pad displacement apparatus, wherein the cleaning pad is for attaching to the cleaning pad displacement apparatus to displace the cleaning pad across a floor surface in cleaning engagement therewith.

18. The cleaning pad of claim 16, wherein the strip of relatively higher absorbency material comprises about 80% polyester and 20% polyamide and the first and second strips of relatively lower absorbency material comprise polyester.

19. A method of manufacturing a cleaning pad comprising the steps of:

providing a generally rectangular body comprising:

a top material layer for securing to a cleaning pad displacement apparatus; and a bottom material layer for making contact with a floor surface;

wherein the top material layer and bottom material layer are secured to each other;

wherein the bottom material layer is generally rectangular in shape and includes first and second longitudinal edges and first and second lateral edges; wherein the bottom material layer further includes a first and a second strip of relatively lower absorbency material and a strip of relatively higher absorbency material;

wherein the first strip of relatively lower absorbency material extends along the first longitudinal edge from the first lateral edge to the second lateral edge;

wherein the second strip of relatively lower absorbency material extends along the second longitudinal edge from the first lateral edge to the second lateral edge;

wherein the strip of relatively higher absorbency material extends from the first lateral edge to the second lateral edge and between the first strip and the second strip of relatively lower absorbency material; and wherein the first and second strips of said relatively lower absorbency material and the strip of relatively higher absorbency material are substantially equal height and form a substantially coplanar floor engaging surface.

20. The method of manufacturing a cleaning pad of claim 19 further comprising the step of:

providing a cleaning pad displacement apparatus, wherein the cleaning pad is for attaching to the cleaning pad displacement apparatus to displace the cleaning pad across a floor surface in cleaning engagement therewith.

21. The method of manufacturing a cleaning pad of claim 19, wherein the first and second strips of relatively lower absorbency material comprise loop microfiber and the strip of relatively higher absorbency material comprises cut microfiber.

22. The method of manufacturing a cleaning pad of claim 19, wherein the strip of relatively higher absorbency material comprises about 80% polyester and 20% polyamide and the first and second strips of relatively lower absorbency material comprise polyester.

* * * * *